United States Patent [19]

Weiss

[11] 4,422,001

[45] Dec. 20, 1983

[54] CRYSTAL VIBRATOR ACTUATED RELAY

[76] Inventor: Gerhart Weiss, 76-70 172nd St., Flushing, N.Y. 11366

[21] Appl. No.: 270,940

[22] Filed: Jun. 5, 1981

[51] Int. Cl.[3] ..... H01H 45/00; H04R 17/00

[52] U.S. Cl. ..... 310/328; 200/181

[58] Field of Search ..... 310/328, 330, 331, 332; 200/181

[56] References Cited

U.S. PATENT DOCUMENTS

| | | | |
|---|---|---|---|
| 2,195,417 | 4/1940 | Mason | 310/328 X |
| 2,835,761 | 5/1958 | Crownover | 200/181 |
| 3,405,289 | 10/1968 | Gikow | 310/328 |
| 3,430,020 | 2/1969 | Von Tomkewitsch et al. | 200/181 |
| 3,688,135 | 8/1972 | Koda et al. | 200/181 X |

*Primary Examiner*—Peter S. Wong

*Attorney, Agent, or Firm*—Blum, Kaplan, Friedman, Silberman & Beran

[57] ABSTRACT

A crystal vibrator actuated relay device including a switch having a contact button displaceable between first and second positions, the switch being open at one of the positions and closed at the other of the positions. A first lever arm is coupled to the contact button and is displaceable with the contact button between first and second positions corresponding to the first and second positions respectively of the contact button. A bias means as provided for biasing the contact button to the first position. A crystal vibrator is coupled through first and second coupling members to the first lever arm, the vibration of one of the coupling members causing one of the two coupling members to be displaced, to in turn displace the first lever arm to its second position to selectively control the switching of the switch.

24 Claims, 22 Drawing Figures

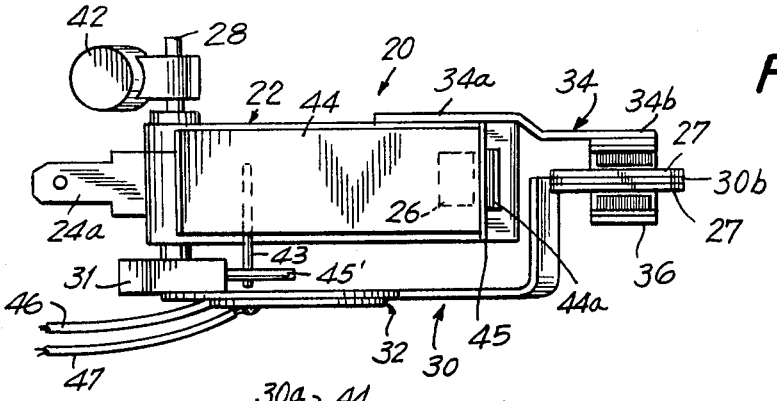
FIG. 1
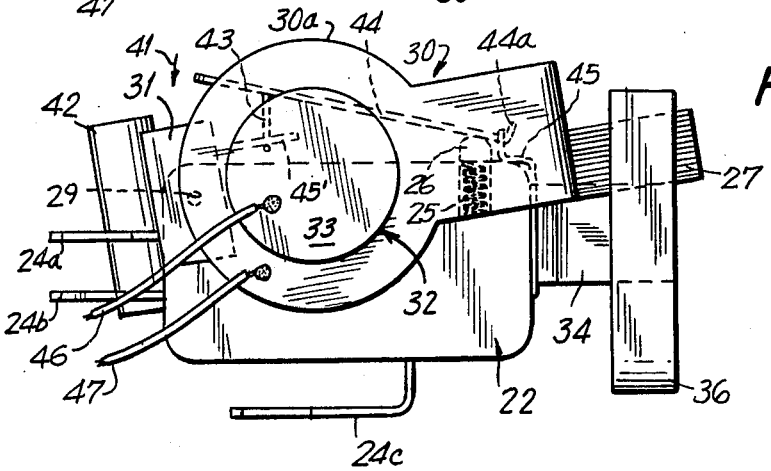
FIG. 2
FIG. 3
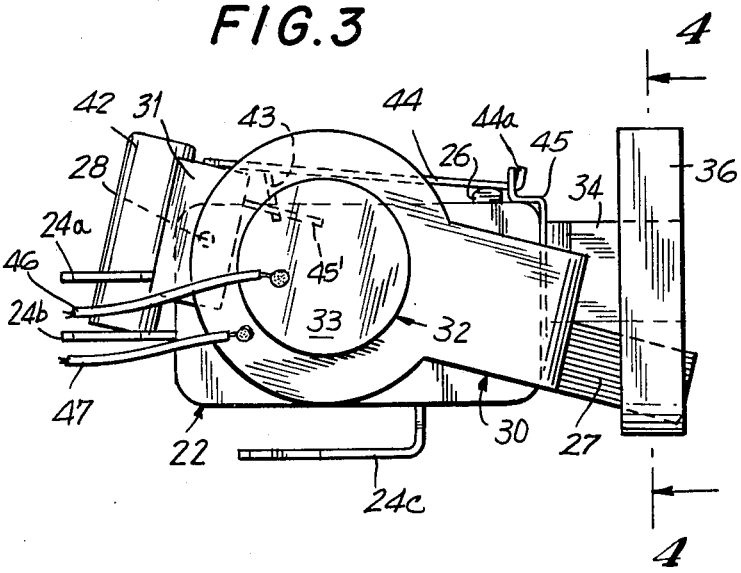
FIG. 4
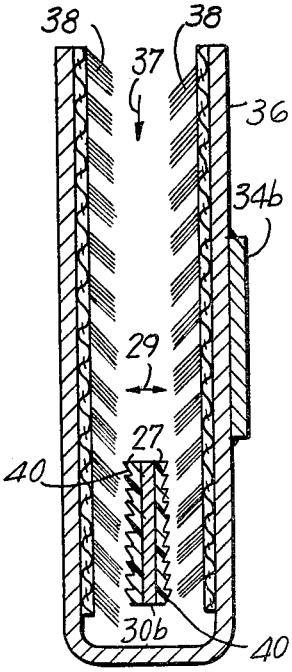

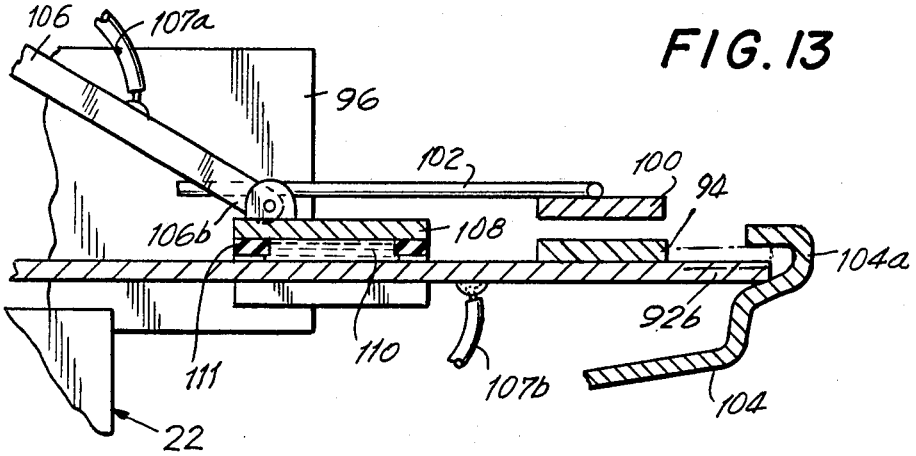
FIG. 13
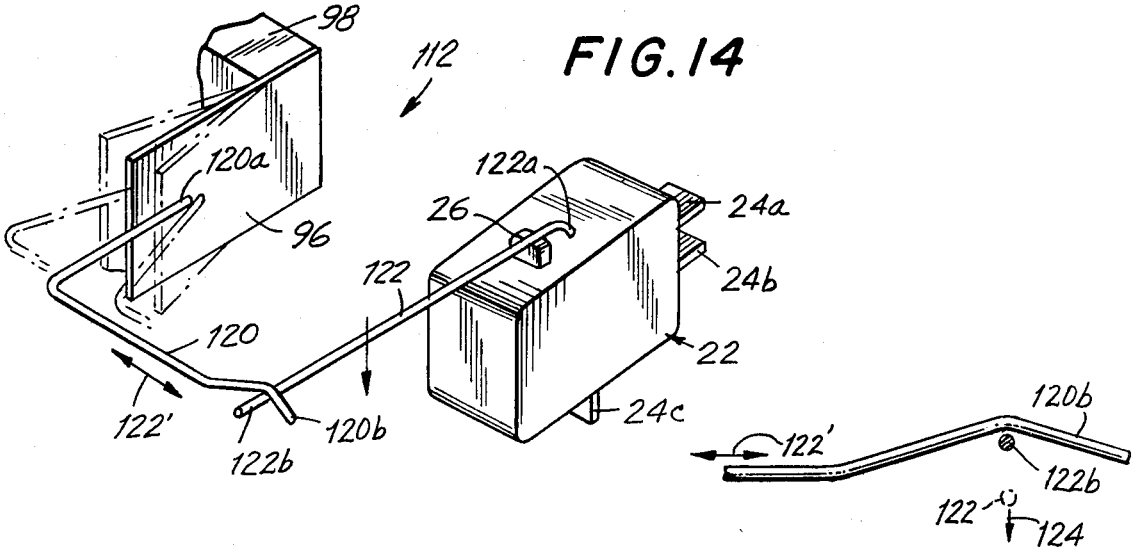
FIG. 14
FIG. 15
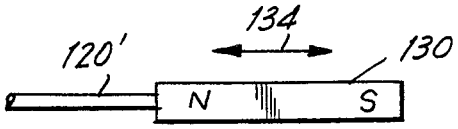
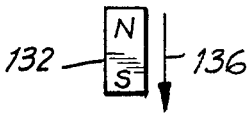
FIG. 16

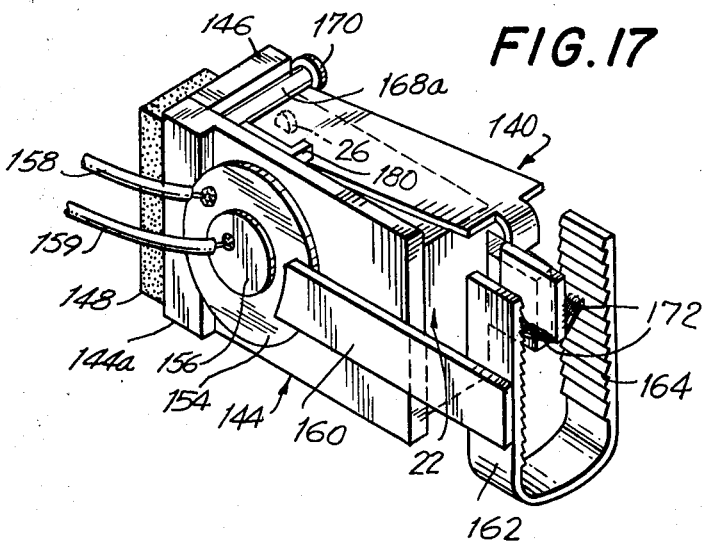
FIG. 17
FIG. 18
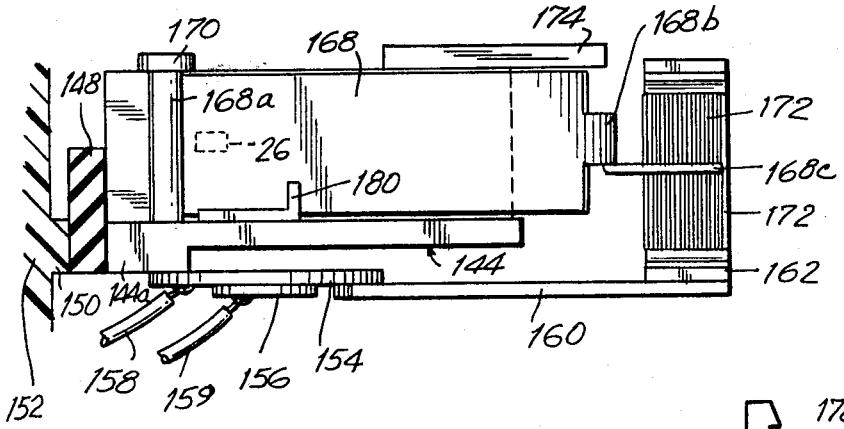
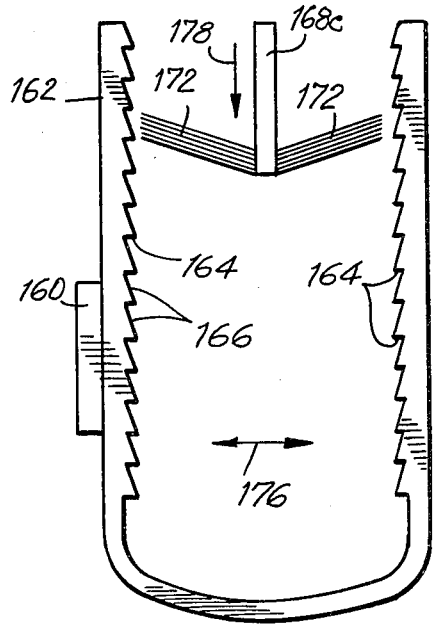
FIG. 19

CRYSTAL VIBRATOR ACTUATED RELAY

BACKGROUND OF THE INVENTION

This invention is directed to a crystal vibrator actuated relay and, in particular, to a piezoelectric crystal relay wherein the vibratory motion of a piezoelectric crystal is used to selectively open and close a switch or the like.

The numerous applications of relays are well known. Relays are utilized wherever switching between various terminals or coupling between contacts is required. One such application is in telephone switching systems wherein different electrical devices are selectively actuated by relays in order to switch between various signals.

Various types and constructions of relays are known in the art. These prior art relays are generally electromagnetic in construction utilizing inductance techniques to operate. Inductance-type relays utilize on the average of 100 milliamps to operate each time these relays are actuated and about 20 milliamps as a holding current. Due to the substantial increase in electric costs in recent years and the concern for conservation of energy resources, it is extremely desirable to reduce electric consumption as much as possible. Accordingly, a relay which requires substantially less electricity to operate and is therefore cheaper to operate and yet is efficient and easy to construct, is urgently desired.

SUMMARY OF THE INVENTION

Generally speaking, in accordance with the instant invention, a crystal vibrator actuated relay device, is provided. The relay device includes a switch having a contact button displaceable between first and second positions, the switch being open at one said position and closed at the other said position. A first lever arm is coupled to the contact button and is displaceable with the contact button between first and second positions corresponding to the first and second positions respectively of the contact button. A bias means is provided for biasing said contact button to said first position. A crystal vibrator is coupled through a coupling means to the first lever arm, said coupling means effecting the displacement of the first lever arm between its first and second positions in response to the vibration of said vibrator, and adapted to permit the return of the first lever arm to its first position upon termination of vibration, thus selectively controlling the switching of the switch. The coupling means may include first and second interactive coupling members, said first coupling member being joined to the vibrator, the second coupling member being either joined to the first lever arm or fixed relative to the displacement of the first lever arm. In the latter case, the coupling means includes a second lever arm supporting said vibrator and first coupling member and mounted for displacement between first and second positions, said second lever arm being coupled to said first lever arm so that displacement of said second lever arm in response to the vibration of said vibrator and the interaction of said first and second coupling members, causes displacement of said first lever arm and therefore said contact button between their respective first and second positions.

In a first embodiment of the invention, the coupling means includes a first member bearing a plurality of projections spaced essentially in the direction of displacement of said first lever arm and a second member bearing a plurality of bristles facing said projections and normally spaced therefrom. The projections and bristles are shaped so that the vibration of one against and away from the other causes the first lever arm to be displaced. The projections may be spaced ribs while the bristles may be inclined relative to the plane of the ribs.

In a second embodiment, the coupling means may include a first V-shaped member joined to the vibrator for vibration in the plane of the "V", and a second bar member normally positioned essentially in the apex of the V-shaped member and joined to the first lever arm, the vibration of the V-shaped member displacing the bar member to a position between the arms of the "V" spaced from the apex thereof, to thereby displace the first lever means.

In a third embodiment, the coupling means first and second members may include first and second magnet means respectively joined to the vibrator and first lever means in facing relation so that the interaction of the poles thereof cause displacement of the first magnet toward or away from the second magnet during vibration to effect displacement of said first lever arm.

In other embodiments, the contact button may be selectively retained at the second position by use of an electroviscous fluid which changes viscosity upon application of a potential thereto is or an electrostatic clutch material which engages upon the application of potential thereto.

Accordingly, it is an object of the present invention to provide a crystal vibrator actuated relay.

Another object of the present invention is to provide a crystal vibrator actuated relay which uses substantially less power than conventional relays.

A further object of the present invention is to provide a crystal vibrator actuated relay which is easy to and relatively inexpensive to manufature and which has a variety of uses.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a top plan view of a first embodiment of a crystal vibrator actuated relay constructed in accordance with the present invention;

FIG. 2 is a side elevational view of the relay depicted in FIG. 1 shown in its rest position;

FIG. 3 is a side elevational view of the relay depicted in FIG. 1 in actuated position;

FIG. 4 is an enlarged sectional view taken along lines 4—4 of FIG. 3;

FIG. 13 is an enlarged sectional view taken along lines 13—13 of FIG. 12;

FIG. 14 is a perspective view of a fifth embodiment of the crystal vibrator actuated relay constructed in accordance with the present invention;

FIG. 15 is an enlarged view which depicts the displacement of the coupling members of the relay of FIG. 14;

FIG. 16 depicts alternate magnetic coupling members for the mechanical coupling members depicted in FIG. 15;

FIG. 17 is a perspective view of a sixth embodiment of the crystal vibrator actuated relay in accordance with the present invention;

FIG. 18 is a top plan view of the relay of FIG. 17;

FIG. 19 is an enlarged view of the coupling members of the relay of FIG. 17;

DESCRIPTION OF THE PREFERRED EMBODIMENTS

Figure 5:
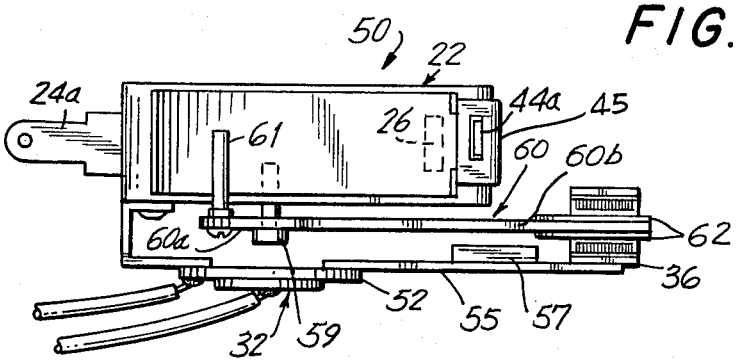
FIG. 5 is top plan view of a second embodiment of a crystal vibrator actuated relay constructed in accordance with the present invention.

Reference is first made to FIGS. 1 through 3 wherein a relay, generally indicated as 20, constructed in accordance with a first embodiment of the present invention, is depicted. Relay 20 includes a conventional switch 22 having normally open contact terminal 24*a*, normally closed contact terminal 24*b* and common terminal 24*c*.

Switch 22 operates in the conventional manner and includes a contact button 26 which is displaceable between raised (FIG. 2) and depressed (FIG. 3) positions. Contact button 26 is normally biased in its raised position by a spring 25 (FIG. 2). Switch 22 is "open" when contact button 26 is in its raised position, at which terminal 24*a* is disconnected from terminal 24*c* and terminal 24*b* is connected to terminal 24*c*, and is "closed" when contact button 26 is in its depressed position, at which terminal 24*a* is connected to terminal 24*c* and terminal 24*b* is disconnected from terminal 24*c*. Accordingly, switch 23 may be used as a conventional on-off switch in a circuit or to perform any other function performed by a switching relay. Other configurations of button-actuated switches may be used in place of switch 22.

Referring to FIGS. 1 through 4, rod 28 is rotatably mounted in a through hole 29 in switch 22. A lever arm 30 is secured at one end thereof to an end of rod 28 projecting on one side of switch 22 by means of a coupling plate 31. The other end 30*b* of lever arm 30 includes pads 27 on both sides thereof which have a roughened, ribbed or serrated surface as more fully described below. A piezoelectric crystal disk 32 is secured to region 30*a* of arm 30 by an adhesive such as glue or the like. Piezoelectric crystal 32 will vibrate in an oscillatory motion as illustrated by arrow 29 of FIG. 4 when a potential is applied across the crystal through leads 46 and 47. Lever arm 30 is formed of a conductor or has a conductor deposited thereon extending from lead 46 to the under surface of crystal 32. A conductive layer is deposited on surface 33 of crystal 32 for electrical coupling with lead 47.

Piezoelectric crystal 32 is preferably selected from the family of zirconium titanates. One preferred type of zirconium titanate used as piezoelectric crystal 32 in the PZT (platinum-zirconium-titantate) crystal. It is noted that other types of crystals such as quartz crystals may be utilized.

A mounting bracket 34 is secured at one end 34*a* thereof to switch 22. The other end 34*b* of bracket 34 supports a U-shaped member 36. As best viewed in FIG. 4, U-shaped member 36 supports a plurality of flocked material such as bristles 38 on both inner walls thereof. In the embodiment depicted in FIGS. 1 through 4, bristles 38 are mounted in U-shaped member 36 so that they point downward (as viewed in FIG. 4) at about a 45° angle to the walls of U-shaped member 36. As aforenoted, end 30*b* of arm 30 includes pads 27 having a roughened, ribbed or serrated surface. Referring to FIG. 4, it is seen that this surface includes a plurality of laterally extending teeth or ribs 40 defined by upwardly inclined (as viewed in FIG. 4) surfaces. In its rest position (FIGS. 1 and 2), a small gap is provided between bristles 38 and teeth 40 so that lever arm 30 can move freely up and down between the bristles. The other projecting end of rod 28 carries a counterweight 42 which balances lever arm 30 and the crystal and pads carried thereon so that arm 30 can be readily displaced.

A switch lever arm 44 is pivotally coupled to the top of switch 22 proximate contact button 26 so as to be operatively coupled to button 26. Specifically, a tab 44*a* on one end of switch lever arm 44 is pivotably engaged in a bracket 45 secured to switch 22. The other end of switch lever arm 44 is mechanically coupled to lever arm 30 by means of pin 43 mounted on and which extends from switch arm 44 which engages with pin 45' which is mounted on and extends from coupling plate 21 so as to be displaced thereby.

In operation, in the rest position, the arms are positioned as depicted in FIG. 2. When a potential is applied across crystal 32 through leads 46 and 47, the crystal will be caused to vibrate at a high rate. The vibration of crystal 32 will accordingly cause lever arm 30 to which it is attached to oscillate back and forth in the direction of arrow 39 in FIG. 4. This will cause end 30*b* bearing ribbed pads 27 to also vibrate. The teeth 40 on pads 27 will vibrate against the downward facing bristles 38 which will cause the roughened surface to "walk" down the bristles in the direction of arrow 37 due to a downward force exerted on vibrating teeth 40 by means of bristles 38, which are inclined in the direction of displacement of lever arm 30. Since switch lever arm 44 is coupled to lever arm 30, it will be pulled down (as viewed in FIG. 2) with lever arm 44 as indicated by arrow 41 in FIG. 2 to the position shown in FIG. 3. This will force contact button 26 down thereby causing it to close switch 22 and hence couple terminals 24*b* and 24*c* together.

The continued vibration maintains the switch in the position of FIG. 3. When the potential across crystal 32 is turned off, arm 30 will return to the position depicted in FIG. 2 since the teeth 40 on pads 27 do not contact bristles 38 when in a rest position, as depicted in FIG. 4. The upward biasing of button 26 by spring 25 causes lever arms 30 and 44 to return to the start position depicted in FIG. 2 and the contact button 26 to return to the open position.

Thus, as depicted in FIGS. 1 through 4, the oscillatory motion of crystal 32 is translated into lateral displacement of the respective lever arms 30 and 44 by the coupling members 38, 40 to selectively operate relay switch 22. Relay 20 uses only about 12 milliamps to operate switch 22 thus using about 10% of the power normally required in operating conventional relays.

Reference is now made to FIGS. 5 through 8 which depict a second embodiment of a relay, generally indicated as 50, according to the present invention. Like reference numerals refer to like elements depicted in FIGS. 1 through 4. In this embodiment, the same switch 22 is used which includes terminals 24*a*, 24*b* and 24*c*.

Switch lever arm 44 is pivotally coupled to switch 22 by tab 44*a* thereof and bracket 45, proximate contact button 26 so as to operate button 26 between its raised and depressed positions to open and close switch 22 as described above. A mounting bracket 54 is fixed to switch 22 and supports a conductive disc 52 in spaced relation to switch 22. Mounting bracket 54 is stationery. A vibration arm 55 is secured to disk 52 at a point on the disk opposed to the bracket 54 and supports the U-shaped bracket 36 at the end thereof. In this embodiment, U-shaped bracket 36 supports upward pointing (as viewed in FIG. 7) flocked material bristles 58 which form about a 45° angle with respect to the walls of bracket 56. Two facing sets of bristles 58 are provided.

A lever 60 is pivotally mounted to the side of switch 22 by means of pin 59 at an interior portion thereof so that lever arms 60*a* and 60*b* of lever 60 extend from pin 59. Lever arm 60 of lever 60 supports a pin 61 which engages with the upper surface of switch arm 44. Lever arm 60*b* of lever 60 supports serrated or ribbed pads 62 on both sides thereof having downwardly pointing teeth 67 (as viewed in FIG. 7).

Figure 6:
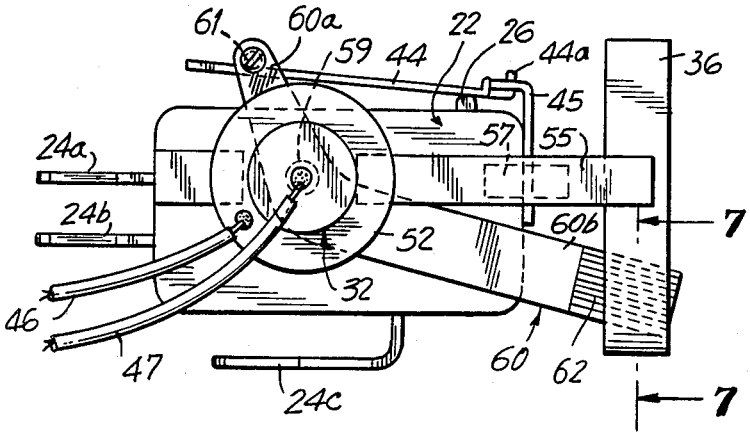
FIG. 6 is a side elevational view of the relay depicted in FIG. 5.
Figure 7:
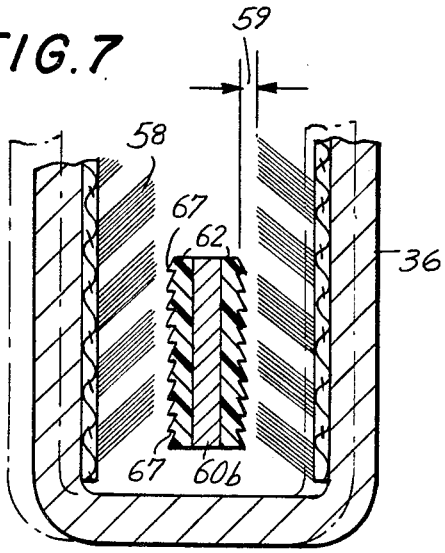
FIG. 7 is an enlarged sectional view taken along lines 7—7 of FIG. 6.

Vibration arm 55 supports a weight 57 which is used to tune the vibration of the assembly. Piezoelectric crystal 32 is mounted on disk 52. Crystal 32 and disk 52 are generally referred to as a unimorph, creating the desired lateral vibration of U-shaped member 36. FIGS. 6 and 7 depict the rest or start position of lever arm 60 wherein contact button 26 is in its raised position so that switch 22 is open. In this rest position, there is a slight gap indicated on one side by arrows 59 between pads 62 and bristles 58.

Figure 8:
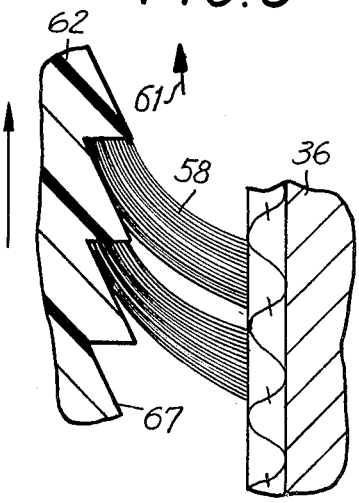
FIG. 8 is an enlarged partial sectional view depicting the interaction of the bristles and the ribbed surface of the relay depicted in FIG. 5.

When piezoelectric crystal 32 is energized by applying a potential between leads 46 and 47, it will vibrate as fully described above. This vibration will cause vibration arm 55 and hence U-shaped member 56 to vibrate back and forth as shown in phantom in FIG. 7 toward and away from pads 67. Bristles 58 will vibrate against pads 62 and will cause an upward force on teeth 67 thereof as depicted in FIG. 8 thereby causing the upward movement (as viewed in FIGS. 7 and 8) of lever arm 60*b* of lever 60 as indicated by arrow 61 in FIG. 8. The upward movement of the lever arm 60*b* of lever 60 will cause lever 60 to pivot about in a counter clockwise direction as viewed in FIG. 6 its pivoting point defined by pin 59 thereby causing the downward movement of the lever arm 60*a* of lever 60. This in turn will cause a downward force on switch arm 44 caused by the pressing of pin 61. This exerts a downward force on contact button 26 to thereby close switch 22. Upon deactivation of piezoelectric crystal 32, the arms will return to the position depicted in FIG. 6 due to the construction of lever 60 and the upward biasing force on switch arm 44 by the internal spring (not shown) coupled to contact button 26 to thereby close switch 22. Upon deactivation of piezoelectric crystal 32, the arms will return to the position depicted in FIG. 6 due to the construction of lever 60 and the upward biasing force on switch arm 44 by the internal spring (not shown) coupled to contact button 26.

In the embodiment depicted in FIGS. 5 through 8, it is the U-shaped member and bristles thereon which vibrate whereas in FIGS. 1 through 4, the U-shaped member and bristles are stationary and the pads vibrate. In both embodiments the coupling permits the return of the switch to its original position upon termination of vibration, yet only the relatively low power demand of the crystal vibrator was required to actuate the switch.

Figure 9:
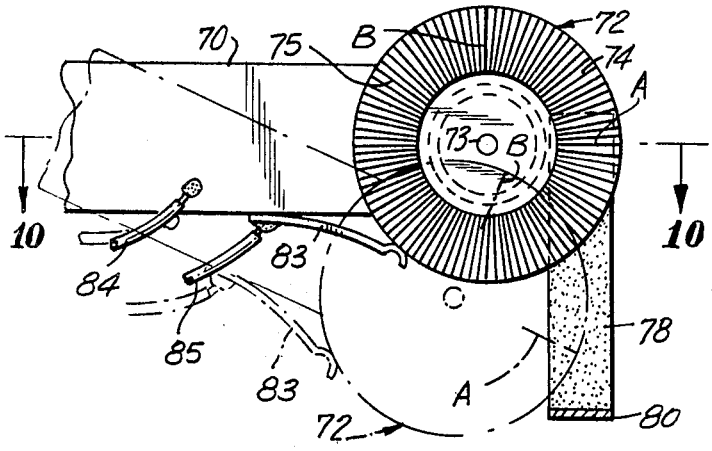
FIG. 9 is a fragmentary side elevational view of a third embodiment of a crystal vibrator actuated relay constructed in accordance with the present invention with the displaced portion being shown in phantom.
Figure 10:
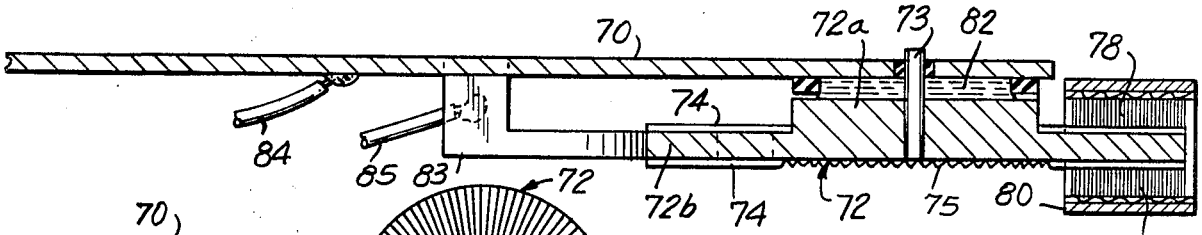
FIG. 10 is an enlarged sectional view taken along lines 10—10 of FIG. 9.
Figure 11:
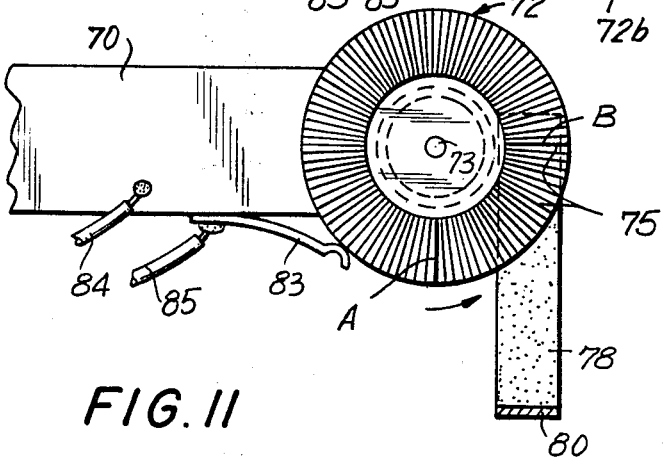
FIG. 11 is a side elevational view showing the rotation of one coupling member after actuation of the switch has been effected by the relay depicted in FIG. 9.

Referring now to FIGS. 9 through 11, a third embodiment of the relay device of the present invention is depicted. The basic switch, vibrator and lever arrangement corresponds to that of FIGS. 5–8, this embodiment differing in the structure of the coupling means.

A lever arm 70 is pivotably mounted in the manner of lever arm 60*b* and includes a disk 72 rotatably mounted thereon by means of a shaft 73. Disk 72 includes a pair of concentric annular pads 74 attached to the outer surface of both sides thereof. Each pad has a plurality of radially extending ribs 75. Disk 72 has a hub portion 72*a* and a flange 72*b*, the pads 74 being supported on said flange portion. Two radii on disk 72 are indicated by letters A and B.

Bristles 78 are mounted on U-shaped member 80, which in turn would be mounted on a vibration arm (not shown) which in turn would be coupled to a crystal vibrator as shown in the embodiment of FIG. 5. As best viewed in FIG. 10, in this embodiment bristles 78 on U-shaped member 80 always press against pads 74 on disk 72.

Disk 72 may be held in a stationary position, i.e. may be prevented from rotating on shaft 73 by means of an electroviscous fluid 82 between lever arm 70 and disk 72. Electroviscous fluid 82 is such that when not electrically activated it is low in viscosity and therefore will not interfere in the rotation of disk 72. By applying a small potential across electroviscous fluid 82 by means of leads 84 and 85, its viscosity increases and it therefore locks or prevents rotation of disk 72. Washer 81 is provided to retain the fluid and prevent shortcircuiting of disk 72 and lever arm 70. Normally the fluid would be held in position by capillary action. Lead 85 is coupled to disk 72 by metal spring finger 82 which rides on the periphery of disk 72. Alternatively, fluid 82 is replaced by a silicon rubber disk and the Johnsen-Rahbeck effect can be utilized as an electrostatic clutch to prevent disk 72 from rotating when rotation thereof is not desired.

In operation, a piezoelectric crystal similar to crystal 32 of FIGS. 5 and 6 is electrically actuated thus causing lever arm 70 and hence pads 72 to vibrate. Electroviscous fluid 82 is simultaneously energized to lock disk 72 to lever arm 70. Pads 72 will vibrate against bristles 78 and will cause the downward movement of lever arm 70 to the position depicted in phantom in FIG. 9. Disk 72, as aforenoted, will not rotate as indicated by the position of radii A and B in FIG. 9 due to the holding thereof by electroviscous fluid 82. Since the bristles press against the ribs 74 at all times, the disk will be held in the position depicted in phantom in FIG. 9 even after the crystal is deenergized and until disk 72 is allowed to rotate by deenergizing electroviscous fluid 82 by cutting off the small potential thereacross. When this happens, disk 72 will be allowed to rotate and will return to the position depicted in FIG. 11, due to the action of the biasing force of the spring in the switch 22. At the new rest position, as shown in FIG. 11, radii A and B have rotated in clockwise direction, demonstrating the rotation of disk 72. Accordingly, the electroviscous fluid 82 permits the locking of the switch 22 in the "closed" position, if desired, by means of the extremely low power required to activate fluid 82, as opposed to the greater power (albeit low) required to sustain vibration of the crystal.

Figure 12:
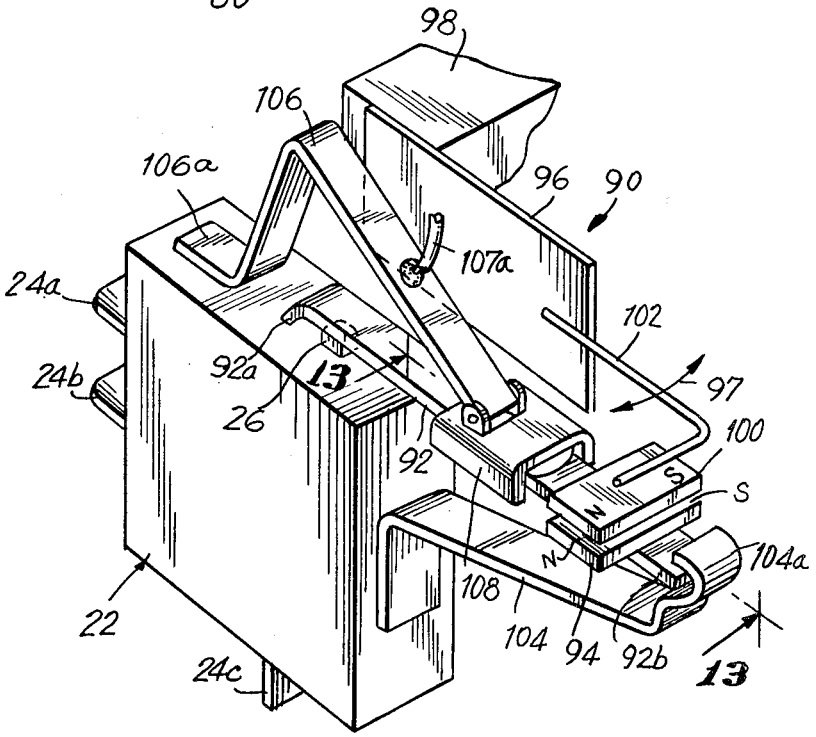
FIG. 12 is a perspective view of a fourth embodiment of the crystal vibrator actuated relay constructed in accordance with the present invention.

Reference is now made to FIGS. 12 and 13 which depict a fourth embodiment of the piezoelectric crystal relay of the present invention, generally indicated as 90. This embodiment uses a magnetic coupling between the vibrating arm and the switch arm as compared with the mechanical couplings discussed above with respect to the first three embodiments. Relay switch 22 includes terminals 24*a*, 24*b* and 24*c* as discussed above. A contact button 26 is provided as discussed above and is used to open and close switch 22.

A switch lever 92 which is upwardly biased by the internal spring in switch 22 is coupled to relay switch 22 at a first end 92*a* thereof in a manner that permits pivoting ad engages contact button 26. The second end 92*b* of switch lever 92 supports a first dipole magnet 94. A crystal vibrator 96 is coupled at one end thereof to an external support 98 and is provided with energizing means (not shown). A second dipole magnet 100 is supported on the other end of vibrator 96 by means of a supporting rod 102 so as to be spaced above magnet 94 as depicted in FIGS. 12 and 13. A bracket 104 mounted on switch 22 includes a curved end 104*a* which inhibits the displacement of upwardly biased switch lever 92 between the lower position depicted in FIG. 13 in full lines at which switch 22 is "closed" and the upper position depicted in in phantom in FIG. 13 where contact button 26 is released to open switch 22. A left spring 106 is mounted at one end 106*a* thereof to the top of switch 22. The other end 106*b* of leaf spring 106 pivotably supports a sliding guide 108 which is slidingly coupled over switch lever 92. An electroviscous fluid 110 is placed between sliding guide 108 and switch lever 92. A washer 111 surrounds fluid 110 to act as an insulating stop.

When the crystal vibrator 96 is actuated, vibrator 96 will vibrate in the direction indicated by arrow 97 and will accordingly cause magnet 100 to oscillate. These oscillations will create a magnetic field which causes a relaxation of the repulsion of magnets 94 and 100. In the rest position, the aligned poles of like polarity cause a repulsion force helping to hold the lever 92 in the position shown in full lines in FIG. 13. After vibration, either a net attraction force or a neutral state is produced, permitting the displacement of the lever 92 to the position shown in phantom in FIG. 13 at which switch 22 is "open". When a potential is applied between leads 107*a* and 107*b*, electroviscous fluid 110 will hold switch bar 92 in its upper or open position as depicted in phantom in FIG. 13 to lock the switch open. When the potential is removed across electroviscous fluid 110, the viscosity thereof will decrease which will free sliding guide 108 to slide along switch lever 92 to allow bar 92 to return to its original position thereby opening switch 22.

By utilizing an electroviscous fluid in the last two embodiments described, power consumption is greatly reduced since the fluid will hold the relay in its closed position by use of low power until selectively released. This provides a great benefit over conventional relays which require continuous power feed of large magnitude for operation, or latching relays which require an unlatching pulse.

Reference is now made to FIGS. 14 and 15 which depict a fifth embodiment of a relay, generally indicated as 112, according to the present invention, like reference numerals being used for like elements. In this embodiment, one end 96*a* of vibrator 96 is mounted on support 98. An arm is secured at one end 120*a* thereof to vibrator 96. The opposite end 120*b* of arm 120 is shaped into an inverted obtuse V-shape. A switch lever 122 is pivotably supported at one end 122*a* thereof on switch 22 and engages contact button 26. The second end 122*b* of switch arm 122 is captured in the V-shaped end 120*b* of arm 120.

In its normal position, switch arm 122 rests within the apex of V-shaped end 120*b* thereby leaving contact button 26 in its raised position so that switch 22 is open. However, when vibrator 96 is vibrated by the piezoelectric crystal thereon as depicted in FIG. 14, arm 122 will be caused to vibrate in the direction of arrow 122' which will cause the downward movement of switch arm 122 as depicted in FIG. 15 by arrow 124. If arm 122 has a greater time constant than $\frac{1}{2}$ the crystal vibration period, arm 122 will remain in the lower position depicted in FIG. 15 thereby keeping button 26 down and switch 22 closed. In effect, despite the oscillation of arm 120, lever 122 assumes an RMS position sufficient to actuate the switch 22.

Referring to FIG. 16, the mechanical coupling depicted in FIGS. 14 and 15 can be replaced by substituting a dipole magnet mounted on arm 120' for the V-shaped end 120*b* of arm 120. A magnet 132 is placed on the end of switch arm 122 with only a single pole thereof positioned for interaction. The magnetic field caused by the oscillation of magnet 130 in the direction of arrow 134 exerts a net downward force in the direction of arrow 136 on magnet 132 which in turn allows contact button 26 to be selectively opened and closed. This magnetic arrangement can also be used in the embodiment of FIGS. 12 and 13.

Referring now to FIGS. 17–19, a sixth embodiment of the relay in accordance with the invention is depicted, like reference numerals being applied to like elements. Relay 140 includes a mounting plate 162 having a thickened base region 144*a*. Switch 22 is secured to one side of plate 144 and to a further rear support 146. A rubber mounting block 148 secures the relay 140 to a rib 150 projecting from a support 152. Rib 150 provides a line mounting of the relay oriented essentially at what would be the base of a tuning fork assembly to be hereinafter described. Conductive plate 154 is secured on one side to thickened region 144*a* of plate 144 and supports piezoelectric crystal 156 which is energizeable through leads 158 and 159 in the manner described above. A vibration arm 160 is secured to conductive plate 154 at a point opposite the mounting on thickened region 144*a* and supports a U-shaped coupling member 162 at the end thereof. U-shaped member 162 is formed with ribs 164 defined by downwardly inclined (as viewed in FIG. 19) walls 166 as described above. A switch lever 168 is pivotably mounted at hinge region 168*a* thereof to plate 144 by means of pin 170 so as to be pivotably mounted and in engagement with button contact 26. Switch lever 168 has a downwardly projecting tab region 168*b* at the extreme end thereof which in turn supports a plate region 168*c*. Plate region 168*c* of switch lever 168 supports upwardly directed (as viewed in FIG. 19) bristles 172 intermediate the ribs of U-shaped coupling member 162.

The foregoing construction defines a tuning fork, one arm of which is represented by U-shaped member 162, vibratory arm 160 and conductive plate 154. The other arm thereof is represented by switch 22, switch lever 168 and a balancing weight 174 secured to the outer side of switch 22. As noted above, this tuning fork is supported for vibration at its base by the resilient block 148. The vibration of both U-shaped coupling member 162 and bristles 172 is in the direction of arrow 176 (FIG. 19), causing bristles 172, and therefor switch lever 168 to "walk" downwardly in the direction of arrow 178 as viewed in FIG. 19. A stop 180 is provided on plate 144 for the purpose of limiting the upward displacement of pivotably mounted switch lever 168.

The advantage of the embodiment of FIGS. 17–19 is that the relay device is mounted at a node so that the vibration is not transmitted to any support structure, thereby reducing noise and other undesired vibratory effects. Nonetheless, the advantages of low power consumption and return to rest position of the switch upon deenergization of the crystal is preserved.

Figure 20:
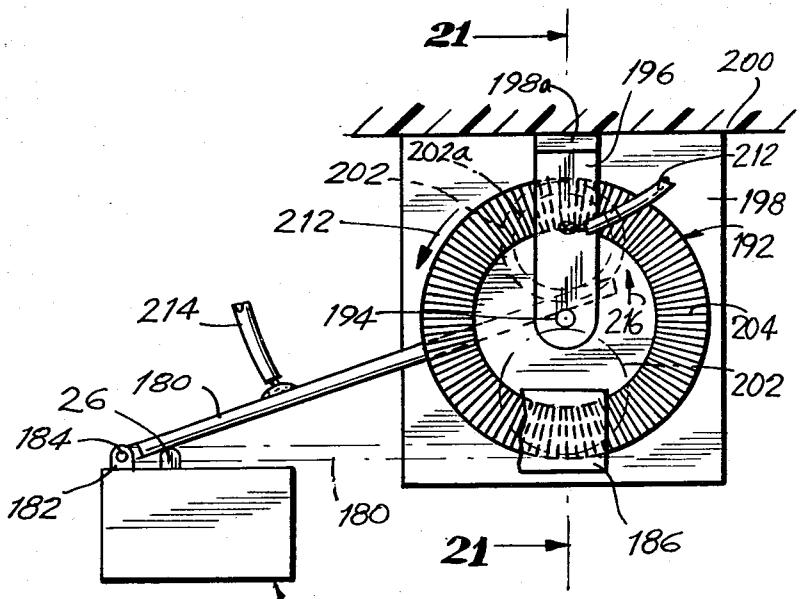
FIG. 20 is a side elevational view of a seventh embodiment of the crystal vibrator actuated relay in accordance with the present invention, with the vibrator broken away.
Figure 21:
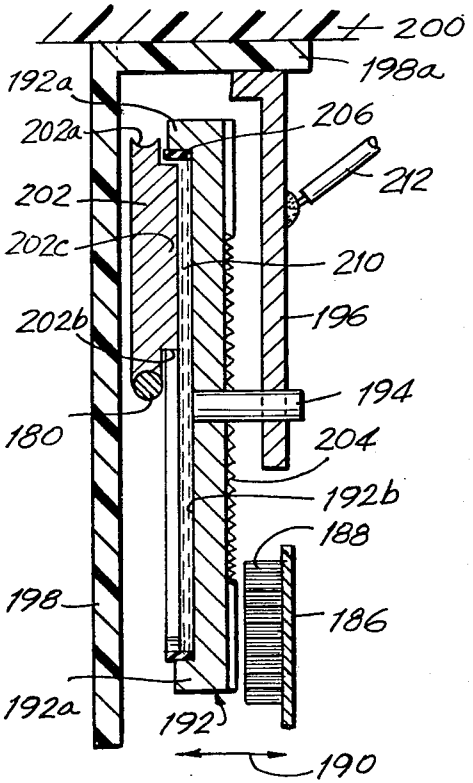
FIG. 21 is an enlarged sectional view along lines 21—21 of FIG. 20.

Referring to FIGS. 20 and 21, a seventh embodiment of the relay in accordance with the invention is depicted. In this embodiment, a switch lever 180 is hingedly mounted by hinge support 182 and pin 184 to the top of switch 22 in engagement with switch button 26. The crystal vibrator is not depicted but would be coupled to a coupling member 186 which supports bristles 188 for vibration in the direction of arrow 190 as described above. A disk 192 would be pivotably mounted on shaft 194 which is in turn supported on a bracket 196, the bracket being itself supported on a projecting portion 198*a* of plate 198. Plate 198 is mounted on a support 200 and is provided to retain a small-diameter disk 202, disk 202 being provided with a peripheral groove 202*a* against which the outer end of switch lever 180 bears. One side of disk 192 is provided with an annular band of radially extending ribs 204 positioned for cooperation with bristles 188 to provide coupling for actuation of the switch in the manner described above. Disk 192 is also provided, on the face opposed to the face bearing ribs 204, with an annular peripheral rib 192*a* which defines a cylindrical recess 192*b* (FIG. 21). An annular insulating washer 206 is received within recess 192*b* abutting the periphery of rib 192*a* and projecting beyond said rib to provide an insulating stop to prevent shortcircuiting connection between disks 202 and 192. Disk 202 is provided with an annular peripheral cut-away region 202*b* which defines a cylindrical projection 202*c* which rides in recess 192*b*. A layer of electroviscous material 210 is received within recess 192*b* and disk 202*c* rides thereon, retained in position by plate 198.

When the vibrator is off, the bias on button contact 26 positions switch lever 180 as shown in FIG. 20 in full lines so as to retain disk 202 in an upper central position as illustrated in full lines in FIGS. 20 and 21. A potential can be applied across electroviscous material 210 by application thereof to leads 212 and 214 which are coupled through conductive elements to disks 192 and 202. If a potential is applied across leads 212 and 214, then disk 202 is "locked" to disk 192. If thereafter or simultaneously, the crystal vibrator is actuated to set bristles 188 in vibration in the direction of arrows 190, the joined disks are caused to rotate as a unit in the direction of arrow 212 (FIG. 20). If the crystal is energized for a predetermined period of time, until disk 202 reaches the position shown in phantom in FIG. 20 (aligned with what is then the bottom of disk 192), and switch 22 is "closed". Since, in this position, switch arm 180 is aligned essentially horizontally, the switch is "locked" closed, held by the low power potential applied to the electroviscous material 210. When the potential is removed from leads 212 and 214, then disk 202 rises in the direction of arrow 216 (FIG. 20) and returns to the rest position, opening the switch. A second layer of electroviscous material were applied between plate 198 and disk 202, and if plate 198 were made of a conductive material insulated from bracket 196, then a second potential could be applied between plate 198 and disk 202 to "lock" the assembly at the position shown in phantom at FIG. 20, removing the criticality of the alignment of switch arm 180 at the "closed" position as well as the criticality of the duration of the application of the vibrator actuating signal.

Figure 22:
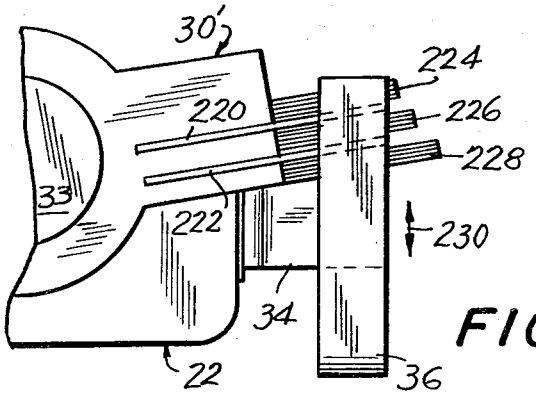
FIG. 22 is a fragmentary side elevational view of an eighth embodiment of the crystal vibrator actuated relay in accordance with the invention.

Referring now to FIG. 22, an eighth embodiment of the relay in accordance with the invention is depicted. This embodiment is based upon the structure of FIGS. 1–4, although the principles herein could be applied to any of the embodiments. Specifically, lever arm 30' which supports the quartz crystal 33 is slit longitudinally thereof by slits 220 and 222 from a region close to the crystal to the end thereof, to define three separate ribbed portions 224, 226 and 228, each portion being of a different thickness and length so as to have different vibratory characteristics. When so constructed, it has been found that the ribbed portions 224, 226 and 228 each vibrate slightly out of phase of the other so that a portion of the ribs are in contact with the bristles supported by U-shaped coupling member 36 over a greater portion of the cycle of vibration, reducing substantially any oscillation of lever arm 30' in the direction of arrow 230 once the "switch closed" position is achieved.

The piezoelectric crystal relay disclosed hereinabove provides a means for operating devices such as switches or the like which substantially reduces the power consumption which characterizes conventional relays. The alternate embodiments provide constructions which are suitable for use in a variety of applications. The relays are easy to manufacture, easy to operate and provide a substantial reduction in power consumption.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A relay device comprising switch means; first lever means coupled to said switch means for actuation thereof and displaceable between first and second positions, said switch means being "open" at one of said first and second positions of said lever means and being "closed" at the other of said first and second positions of said lever means; and vibrator means coupled through a coupling means to said lever means, said coupling means effecting displacement of said lever means between said lever means first and second positions in response to the vibration of said vibrator means, said coupling means including first and second interactive coupling members, said first coupling member being joined to said vibrator means for vibration thereby, one of said vibrator means and said second coupling member being fixed relative to said switch means, the other of said vibrator means and said second coupling member being displaceably mounted relative to said swtich means and joined to said lever means for displacement by the interaction of the vibration of said first coupling member relative to said second coupling member to effect displacement of said lever means between said first and second positions, one of said first and second coupling members including a plurality of projections distributed in the direction of relative displacement of said first and second coupling members, the other of said first and second coupling members including a plurality of resilient fingers facing said projections and adapted to displace the moveable one of said first and second coupling members in said direction in response to the periodic interengagement of said resilient fingers and said projections caused by the vibration of said vibrator means.

2. The relay device as recited in claim 1 and including means for biasing said lever means to its first position, said coupling means being adapted to permit the return of said lever means to its first position upon the termination of the vibration of said vibrator means.

3. The relay device as recited in claim 2, wherein said vibrator means is a crystal vibrator.

4. The relay device as recited in claim 2, and including locking means for selectively locking said lever means in its second position after displacement from said first position independant of the continuation of vibration of said vibrator means, said coupling means being adapted to permit the return of said lever means to its first position upon release of said locking means.

5. The relay device as recited in claim 4, wherein said locking means includes a layer of electroviscous material and means for selectively applying a potential across said electroviscous material, said electro-viscous material being positioned to stop the displacement of said lever means when a potential is applied thereacross and to permit such displacement when said potential is removed.

6. The relay device as recited in claim 4, wherein said locking means is a layer of an electrostatic clutch material, a conductive plate and means for selectively applying a potential therebetween, one of said electrostatic clutch material and said conductive plate being positioned for relative displacement during the displacement of said lever means so that displacement of said lever means is selectively prevented upon the application of a potential between said conductive plate and said electro- static conductive material.

7. The relay device as recited in claim 1, wherein said vibrator means is a crystal vibrator.

8. The relay device as recited in claim 5, wherein said crystal vibrator is a piezoelectric crystal vibrator.

9. The relay device as recited in claim 1, wherein said projections includes a plurality of ribs spaced in the direction of displacement of said one of said first and second coupling members.

10. The relay device as recited in claim 9, wherein said resilient fingers includes a plurality of bristles inclined to aid in the displacement of said one of said first and second coupling members in said direction.

11. The relay device as recited in claim 9, wherein said fingers and projections are normally out of engagement with each other when said vibrator is not vibrating.

12. The relay device as recited in claim 9, said fingers being normally in engagement with said projections when said vibrator means is not vibrating, one of said first and second coupling means being mounted on an annular region of a rotatably mounted plate positioned so that successive portions of said rotatably mounted coupling member come into engagement with the other of said first and second coupling members upon the rotation of said rotatably mounted plate, and including locking means for selectively preventing the rotation of said plate during the displacement of said lever arm said first to said second position and for so long as it is desired to keep said lever arm at said second position after the termination of vibration of said vibrator means, and including means for biasing said lever means to its first position upon the release of said locking means, whereby upon said release relative displacement between said first and second coupling members is as permitted by the rotation of said plate.

13. The relay device as recited in claim 12, wherein said locking means includes a layer of electroviscous material in engagement with said rotatably mounted plates means for selectively applying a potential across said electroviscous material, whereby said plate is prevented from rotation by the drag of said electroviscous material upon the application of a potential thereto.

14. The relay device as recited in claim 12, wherein said locking means includes a layer of an electrostatic clutch material, a conductive plate in engagement therewith and means for applying a potential therebetween, one of said electrostatic clutch material and said conductive plate being coupled to said rotatably mounted plate, whereby the application of said potential prevents the relative motion of said conductive plate and electrostatic clutch material to prevent the rotation of said rotatably mounted plate.

15. The relay device as recited in claim 12, wherein said locking means includes a second plate smaller than said first rotatably mounted plate and positioned for displacement along said first rotatably mounted plate, and including means for selectively preventing displacement of said second plate relative to said first plate during the displacement of said lever means between said first and second positions and thereafter until release of said locking means is desired, means for limiting the displacement of said second plate relative to said first rotatably mounted plate between positions representative of said first and second positions of said lever means, said lever means being coupled to said second plate at least at said second position for the holding of said lever means thereat.

16. The relay device as recited in claim 15, wherein said means for selectively locking said second plate against said first plate and a layer of electro-viscous material therebetween, and means for selectively applying a potential across said electroviscous material to lock said second plate to said first rotatably mounted plate.

17. The relay device as recited in claim 16, wherein said lever means is coupled to said second plate for displacement thereby, and including means for biasing said lever arm to said first position, said potential being applied across said electroviscous material during the vibration of said vibrator means so that the second plate is locked to said first rotatably mounted plate for orbital displacement in response to the rotation of displacement of said rotatably mounted plate to effect displacement of said rotatably mounted plate to effect displacement of said lever means and for retaining said lever means at its second position after the termination of vibration of said vibrator means, upon the removal of said potential from said electroviscous material, the bias on said lever arm displacing said lever arm and second plate to said first position.

18. The relay device as recited in claim 1, wherein said second coupling means is fixed relative to said switch means, said coupling means further including a second lever means supporting said vibrator means and pivotably mounted relative to said switch means said second lever means interengaging with said first-mentioned lever means to displace said first-mentioned lever means between its first and second positions in response to the pivoting of said second lever means by the displacement of said first coupling means and vibrator means during vibration of said vibrator means and first coupling means.

19. The relay device as recited in claim 1, wherein said vibrator is fixed relative to said switch means and includes a support member supporting said vibrator in spaced relation to said switch means, said device defining a tuning fork having a first arm defined by said vibrator means and said first coupling member and a second arm defined by said switch means, lever arm and second coupling member, and including mounting means coupled to the thus-defined tuning fork at a node in the vibration thereof defined by the base thereof.

20. The relay device as recited in claim 1, wherein said first coupling member includes at least two vibrating portions dimensioned so that each of said vibrating portions vibrates out of phase with the other.

21. The relay device as recited in claim 20, wherein said first coupling means vibrating portions are each of a length and thickness different from the length and thickness of the other portions.

22. A relay device comprising switch means; first lever means coupled to said switch means for actuation thereof and displaceable between first and second positions, said switch means being "open" at one of said first and second positions of said lever means and being "closed" at the other of said first and second positions of said lever means; and vibrator means coupled through a coupling means to said lever means, said coupling means effecting displacement of said lever means between said lever means first and second positions in response to the vibration of said vibrator means, said coupling means including first and second interactive coupling members, said first coupling member being joined to said vibrator means for vibration thereby, one of said vibrator means and said second coupling member being fixed relative to said switch means, the other of said vibrator means and said second coupling member being displaceably mounted relative to said switch means and joined to said lever means for displacement by the interaction of the vibration of said first coupling member relative to said second coupling member to effect displacement of said lever means between said first and second positions.

23. The relay device as recited in claim 22 wherein said first and second coupling members include a pair of facing spaced permanent magnets, one of said permanent magnets being positioned for lateral vibratory displacement relative to the other in response to the vibration of said vibrator means, one of said permanent magnets being displaced in the direction of the spacing therebetween in response to the vibration of said one permanent magnet to effect the displacement of said lever means.

24. The relay device as recited in claim 22 wherein said first coupling member includes a V-shaped portion extending in the direction of vibration of said vibrator means, said V-shaped portion including a pair of arms defining an obtuse angle and meeting at an apex, said coupling member including a bar-shaped member positioned in the apex between said arms when said vibrator means is not vibrating, said second coupling member being displaced away from said apex in response to the vibration of said vibrator means and first coupling member to effect displacement of said lever means.

* * * * *